United States Patent [19]

Robson

[11] Patent Number: 4,801,390

[45] Date of Patent: Jan. 31, 1989

[54] LUBRICATING COMPOSITIONS

[75] Inventor: Robert Robson, Oxford, United Kingdom

[73] Assignee: Exxon Research & Engineering Co., Florham Park, N.J.

[21] Appl. No.: 738,694

[22] Filed: May 28, 1985

[30] Foreign Application Priority Data

Jun. 5, 1984 [GB] United Kingdom ..... 8414299

[51] Int. Cl.[4] ..... C10M 125/26

[52] U.S. Cl. ..... 252/25; 252/49.6; 252/51.5 A

[58] Field of Search ..... 252/25, 49.6, 51.5 A

[56] References Cited

U.S. PATENT DOCUMENTS

| | | | |
|---|---|---|---|
| 3,087,936 | 4/1963 | Le Suer | 260/326.3 |
| 3,254,025 | 5/1966 | Le Suer | 252/32.7 |
| 4,068,056 | 1/1978 | Engel et al. | 252/51.5 A |
| 4,068,058 | 1/1978 | Engel et al. | 252/51.5 A |
| 4,089,794 | 5/1978 | Engel et al. | 252/51.5 A |
| 4,113,639 | 9/1978 | Lonstrup et al. | 252/51.5 A |
| 4,137,185 | 1/1979 | Gardiner et al. | 252/33 |
| 4,146,489 | 3/1979 | Stambaugh | 252/51.5 A |
| 4,149,984 | 4/1979 | Wenzel et al. | 252/51.5 A |
| 4,295,983 | 10/1981 | Papay et al. | 252/49.6 |
| 4,455,243 | 6/1984 | Liston | 252/49.6 |
| 4,495,088 | 1/1985 | Liston | 252/49.6 |

FOREIGN PATENT DOCUMENTS

| | | |
|---|---|---|
| 0042270 | 12/1981 | European Pat. Off. . |
| 1271556 | 4/1972 | United Kingdom . |

*Primary Examiner*—William R. Dixon, Jr.
*Assistant Examiner*—Margaret B. Medley
*Attorney, Agent, or Firm*—F. T. Johmann; J. B. Murray, Jr.; M. B. Kapustij

[57] ABSTRACT

Lubricating compositions particularly for crankcase lubrication of gasoline and diesel engines in automobiles and trucks have improved viscometric properties by the incorporation of an ashless dispersant and a dispersant viscosity improver with increased boron content of at least 0.02 wt. % of the composition, preferably in the form of an ashless dispersant borated to a higher level.

5 Claims, 5 Drawing Sheets

DISPERSANT VI IMPROVER Y

LUBRICATING COMPOSITIONS

Figure 1:
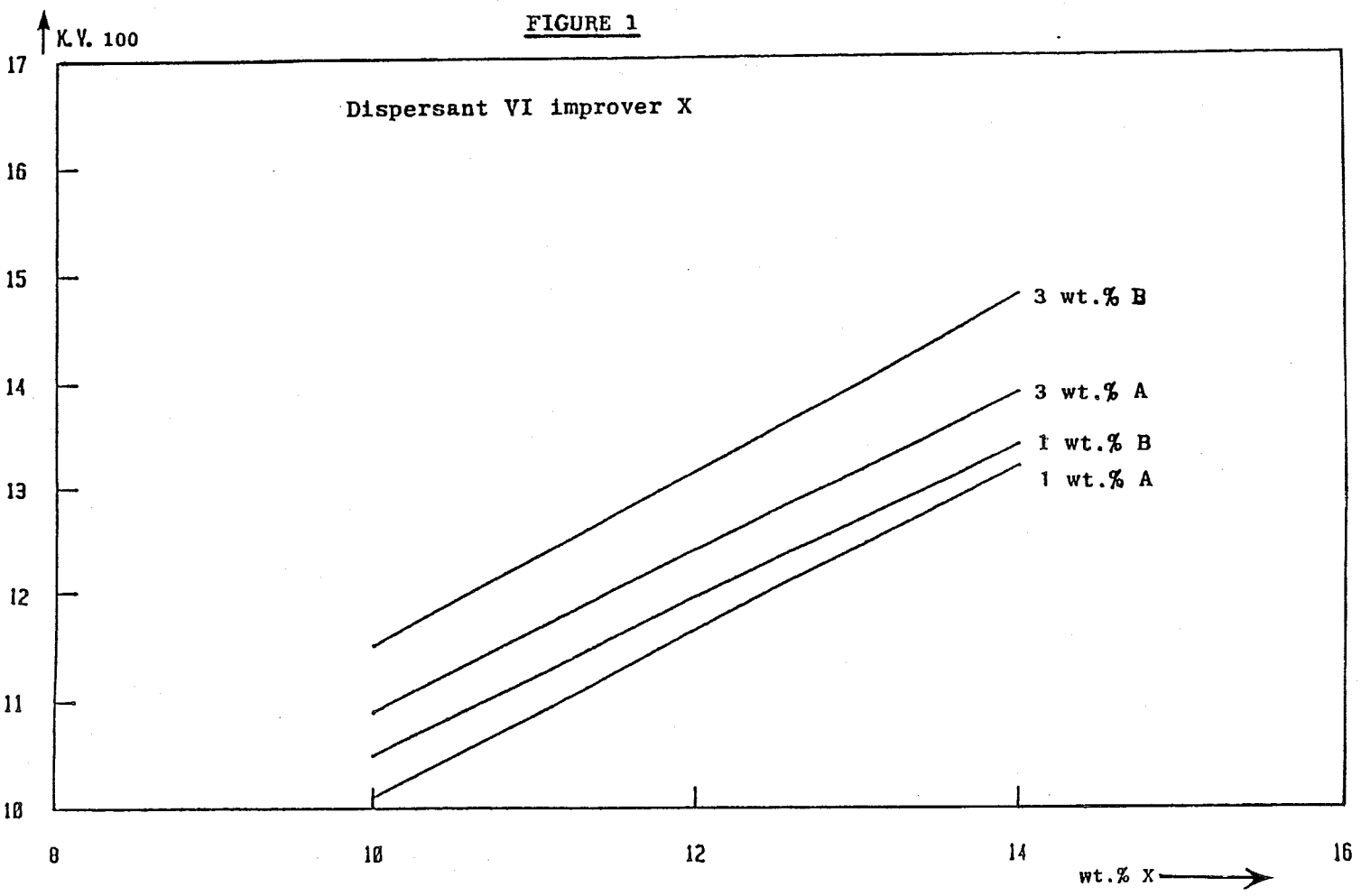

This invention relates to lubricating compositions having improved viscometric properties, together with new combinations of additives providing viscometric advantages and additive concentrates containing such additives. In particular, the invention relates to lubricating compositions for use as crankcase lubricants for automobiles and trucks, in both gasoline and diesel engines. The invention is particularly concerned with additive combinations containing high levels of boron which give improved viscosity performance to the oil.

The viscosity of lubricating oil base stock varies with temperature, so that this viscosity is relatively high at low temperature, thus putting significant loads on engines when starting from cold, and the viscosity is low at engine operating temperature, tending to give reduced lubricating effect. There has been considerable activity in developing additives for lubricating oils which will improve this viscosity performance at different temperatures by giving increased high temperature viscosity without producing an unacceptable increse in the viscosity at lower temperatures. These additives are known as viscosity index (VI) improvers.

A second type of additive is the dispersants which act to disperse or suspend particles such as dirt, carbon and decomposition products which would otherwise form unwanted sludge. The so-called ashless dispersants are well known lubricant additives and a typical category of such dispersants are those derived from alkenyl succinic anhydride and polyamines such as described in U.S. Pat. No. 3,084,763 and U.S. Pat. No. 3,632,511. This type of dispersant can be modified with a boron compound such as described in U.S. Pat. Nos. 3,087,936 and 3,254,025. Mixtures of these dispersants are described in U.S. Pat. No. 4,113,639.

Dispersant VI improvers are also known which combine the activity of dispersants and VI improvers. Typical polymeric dispersant VI improvers are described in U.S. Pat. No. 4,089,794, U.S. Pat. No. 4,160,739, U.S. Pat. No. 4,137,185, U.S. Pat. No. 4,068,056, U.S. Pat. No. 4,068,058, U.S. Pat. No. 4,146,489, U.S. Pat. No. 4,149,984 and U.S. Pat. No. 3,702,300.

It ha now surprisingly been found that the combination of an ashless dispersant with a dispersant VI improver where the combination has a higher boron content than that conventionally employed results in a significant improvement in viscometric performance.

This improvement is not obtained by prior art combinations of an ashless dispersant with a VI improver which does not have dispersant activity even when similar increased boron levels are present. Such prior art combinations are described in GB 1271556 and EP 0042270 which contain no direction to employ a dispersant VI improver in place of a conventional VI.

Accordingly, in one aspect this invention provides lubricating composition comprising a lubricating oil, an ashless dispersant, a dispersant viscosity index improver and boron in an amount of at least 0.020 wt.% of the lubricating composition. In another aspect the invention provides lubricating compositions comprising a lubricating oil, an ashless dispersant containing at least 0.5 wt.% (based on the wt. of ashless dispersant) boron and a dispersant viscosity index improver.

In a further aspect this invention comprises the use in a lubricating composition of an additive combination comprising an ashless dispersant containing at least 0.5 wt.% boron and a dispersant VI improver.

The dispersant used in the present invention may be a traditional lubricating oil ashless dispersant compound such as a derivative of a long chain hydrocarbon substituted carboxylic acids in which the hydrocarbon groups contains from 50 to 400 carbon atoms. This will generally be a nitrogen containing ashless dispersant having a relatively high molecular weight aliphatic hydrocarbon oil solubilising group attached thereto or an ester of a succinic acid/anhydride with a high molecular weight aliphatic hydrocarbon attached thereto and derived from monohydric and polyhydric alcohols, phenols and naphthols.

The nitrogen containing dispersant additives are known in the art as sludge dispersants for crankcase motor oils. These dispersants include mineral oil-soluble salts, amides, imides, oxazolines and esters of of mono- and dicarboxylic acids (and where they exist the corresponding acid anhydrides) formed with various amines and nitrogen containing materials having amino nitrogen or hetercyclic nitrogen and at least one amido or hydroxy group capable of salt, amide, imide, oxazoline or ester formation. Other nitrogen-containing dispersants which may be used in this invention include those wherein a nitrogen containing polyamine is attached directly to the long chain aliphatic hydrocarbon as shown in U.S. Pat. No. 3,275,554 and U.S. Pat. No. 3,565,804 where the halogen group on the halogenated hydrocarbon is displaced with various alkylene polyamines.

The most commonly used dicarboxylic acid is alkenyl succinic anhydride wherein the alkenyl group contains 50 to 400 carbon atoms.

Primarily because of its ready availability and low cost, the hydrocarbon portion of the mono- or dicarboxylic acid or other substituted group is preferably derived from a polymer of a $C_2$ to $C_5$ monoolefin, said polymer generally having a molecular weight of 700 to 5000. Particularly preferred is polyisobutylene.

Polyalkyleneamines are usually the amines used to make the dispersant. These polyalkyleneamines include those represented by the general formula:

$$H_2N(CH_2)_n—[NH(CH_2)_n]m—NH(CH_2)_nNH_2$$

wherein n is 2 or 3, and m is o to 10. Examples of such polyalkyleneamines include diethylene triamine, tetraethylene pentamine, octaethylene nonamine, tetrapropylene pentamine, as well as various cyclic polyalkyleneamines.

Dispersants formed by reacting alkenyl succinic anhydride, eg polyisobutenyl succinic anhydride and an amine are described in U.S. Pat. Nos. 3,202,678, 3,154,560, 3,172,892, 3,024,195, 3,024,237, 3,219,666, 3,216,936 and Belgian Pat. No. 662 875.

The preferred dispersants are those derived from polyisobutenyl succinic anhydride and polyethylene amines, eg tetraethylene pentamine, polyoxyethylene and polyoxypropylene amines, eg polyoxypropylene diamine, trismethylolaminomethane and pentaerythritol, and combinations thereof. One particularly preferred dispersant combination involves a combination of (A) polyisobutenyl succinic anhydride with (B) a hydroxy compound, eg pentaerythritol, (C) a polyoxyalkylene polyamine, eg polyoxypropylene diamine, and (D) a polyalkylene polyamine, eg polyethylene diamine and tetraethylene pentamine using 0.01 to 4 equivalents of (B) and (D) and 0.01 to 2 equivalents of (C) per equivalent of (A) as described in U.S. Pat. No. 3,804,763. Another preferred dispersant combination involves the combination of (A) polyisobutenyl succinic anhydride with (B) a polyalkylene polyamine, eg tetraethylene pentamine, and (C) a polyhydric alcohol or polyhydroxy-substituted aliphatic primary amine, eg pentaerythritol or trismethylolaminomethane as described in U.S. Pat. No. 3,632,511.

The lubricating compositions of the invention preferably contain from 1 to 10 wt.% of the ashless dispersant.

It is preferred that the boron is introduced into the lubricating composition or the additive concentrate of the invention in conjunction with the ashless dispersant, preferably in the form of a borated alkenyl succinic polyamine type dispersant.

The alkenyl succinic polyamine type dispersants can be modified to form such borated dispersants by reaction with a boron compound such as boron oxide, boron halides, boron acids and ester of boron acids as generally taught in U.S. Pat. Nos. 3,087,936 and 3,254,025.

The dispersant employed in the invention preferably contains at least 0.5 wt.% boron (based on the weight of dispersant introduced in this way, more preferably 1 to 10 wt.% boron and most preferably 1.5 to 5 wt.% boron. In a preferred aspect the fully formulated lubricating compositions of the invention will contain at least 0.05 wt.% boron and most preferably 0.05 to 5 wt.% boron.

The invention also employs a dispersant VI improver and examples of suitable additives of this type include:

(a) polymers comprised of $C_4$ to $C_{24}$ unsaturated esters of vinyl alcohol or $C_3$ to $C_{10}$ unsaturated mono- or dicarboxylic acid with unsaturated nitrogen containing monomers having 4 to 20 carbons;

(b) polymers of $C_2$ to $C_{20}$ olefin with unsaturated $C_3$ to $C_{10}$ mono- or dicarboxylic acid neutralised with amine, hydroxy amine or alcohols; and (c) polymers of ethylene with a $C_3$ to $C_{20}$ olefin functionatised by further reaction either by grafting $C_4$ to $C_{20}$ unsaturated nitrogen containing monomers thereon or by grafting an unsaturated acid onto the polymer backbone and then reacting said carboxylic acid groups with an amine, hydroxyamine or alcohol.

In these polymers the preferred amines, hydroxyamines and alcohols are those described above in relation to the ashless dispersant compounds.

It is preferred that the dispersant VI improvers have a number average molecular weight range, as measured by vapor phase osmometry, membrne osmometry, or gel permeation chromatography, of 1,000 to 2,000,000; preferably 5,000 to 250,000 and most preferably 10,000 to 200,000. It is also preferred that the polymers of group (a) comprise a major weight amount of unsaturated ester and a minor, e.g. 0.1 to 40 wt.% (based on total polymer) preferably 1 to 20 wt.%, of a nitrogen containing unsaturated monomer. Preferably the polymer group (b) comprises 0.1 to 10 moles of olefin, preferably 0.2 to 5 moles of $C_2$ to $C_{20}$ aliphatic or aromatic olefin moieties, per mole of unsaturated carboxylic acid moiety and that from 50% to 100% of the acid moieties are neutralized. Preferably the polymer of group (c) comprises an ethylene copolymer of 25 to 80 wt.% ethylene with 75 to 20 wt.% $C_3$ to $C_{20}$ mono and/or diolefin, 100 parts by weight of ethylene copolymer being grafted with either 0.1 to 40, preferably 1 to 20, parts by weight unsaturated nitrogen containing monomer, or being grafted with 0.01 to 5 parts by weight of unsaturated $C_3$ to $C_{10}$ mono or dicarboxylic acid, which acid is 50% or more neutralized.

The unsaturated carboxylic acids used in (a), (b) and (c) above will preferably contain 3 to 10 more usually 3 or 4 carbon atoms and may be monocarboxylic such as methacrylic and acrylic acid or dicarboxylic such as maleic acid, maleic anhydride and fumaric acid.

Examples of unsaturated esters that may be used include these derived from aliphatic saturated mono alcohols of at least 1 carbon atom and preferably of from 12 to 20 carbon atoms such as decyl acrylate, lauryl acrylate, stearyl acrylate, eicosanyl, acrylate, docosanyl acrylate, decyl methacrylate, diamyl fumarate, lauryl methacrylate, cetyl methacrylate and stearyl methacrylate and mixtures thereof.

Other esters include the vinyl alcohol esters of $C_2$ to $C_{22}$ fatty or mono carboxylic acids, preferably saturated such as vinyl acetate, vinyl laurate, vinyl palmitate, vinyl stearate and vinyl oleate and mixtures thereof.

Examples of suitable unsaturated nitrogen containing monomers containing 4 to 20 carbon atoms which can be used in (a) and (c) above include the amino substituted olefins such as p-(beta-diethylaminoethyl)styrene; basic nitrogen-containingheterocycles carrying a polymerizable ethylenically unsaturated substituent, eg the vinyl pyridines and the vinyl alkyl pyridines such as 2-vinyl-5-ethyl pyridine, 2-methyl-5-vinyl pyridine, 2-vinyl-pyridine, 3-vinyl-pyridine, 4-vinyl-pyridine, 3-methyl-5-vinyl-pyridine, 4-methyl-2-vinyl-pyridine, 4-ethyl-2-vinyl-pyridine and 2-butyl-5-vinyl-pyridine.

N-vinyl lactams are also suitable, and particularly when they are N-vinyl pyrrolidones or N-vinyl piperidones. The vinyl radical preferably is unsubstituted ($CH_2{=}CH{-}$), but it may be mono-substituted with an aliphatic hydrocarbon group of 1 to 2 carbon atoms, such as methyl or ethyl.

The vinyl pyrrolidones ae the preferred class of N-vinyl lactams and are exemplified by N-vinyl pyrrolidone, N-(1-methylvinyl)pyrrolidone, N-vinyl-5-methyl pyrrolidone, N-vinyl-3, 3-dimethyl pyrrolidone, N-vinyl-5-ethyl pyrrolidone, N-vinyl-4-butyl pyrrolidone N-ethyl-3-vinyl pyrrolidone. N-butyl-5-vinyl pyrrolidone, 3-vinyl pyrrolidone, 4-vinyl pyrrolidone, 5-vinyl pyrrolidone and 5-cyclohexyl-N-vinyl pyrrolidone.

Examples of olefins which could be used to prepare the copolymers of (b) and (c) above include mono-olefins such as propylene, 1-butene, 1-pentene, 1-hexene, 1-heptene, 1-decene, 1-dodecene, styrene, etc.

Representative non-limiting examples of diolefins that can be used in (c) include 1,4-hexadiene, 1,5-heptadiene, 1,6-octadiene, 5-methyl-1-4-hexadiene, 1,4-cyclohexadiene, 1,5-cyclo-octadiene, vinyl-cyclohexane, dicyclopentenyl and 4,4'-dicyclohexenyl such as tetrahydroindene, methyl tetrahydroindene, dicyclopentadien, bicyclo(2,2,1)hepta-2, 5-diene, alkenyl, alklidiene, 5-methylene-2-norbornene and 5-ethylidence-2-norbornene.

Typical polymeric dispersant VI improvers include copolymers of alkyl methyacrylates with N-vinyl pyrrolidone or dimethylaminoalkyl methacrylate, alkyl fumarate-vinyl acetate N-vinyl pyrollidine copolymers, post-grafted interpolymers of ethylene-propylene with an active monomer such as maleic anhydride which may be further reacted with an alcohol or an alkylene polyamine, eg see U.S. Pat. Nos. 4,089,794, 4,160,739 and 4,137,185; or copolymers of ethylene and propylene reacted or grafted with nitrogen compounds such as shown in U.S. Pat. No. 4,068,056, 4,068,058, 4,146,489 and 4,149,984; styrene/maleic anhydride polymers post-reacted with alcohols and amines, ethoxylated derivatives of acrylate polymers, eg see U.S. Pat. No. 3,702,300.

The dispersant VI improvers of category (c) are particularly preferred, especially the ethylene-propylene copolymers post-grafted with maleic anhydride and then further reacted with a polyamine.

The lubricating compositions of the invention preferably contain from 5 to 20 wt.% of the dispersant VI improver.

The high boron contents of the lubricating compositions of the invention containing ashless dispersant and a dispersant VI improver result in improved viscometric behavior of the lubricating composition, and in particular in an improved high temperature kinematic viscosity without an undesirable increase in the low temperature viscosity characteristics of the composition. Thus, for a given level of treatment with the dispersant and dispersant VI improver the increased boron level according to the invention versus that which was conventionally employed results in a higher kinematic viscosity at elevated temperature. Alternatively, if the lubricating oil is formulated to give a certain high temperature kinematic viscosity the invention enables a lower treat rate of dispersant VI improver to be employed with a resulting decrease in the low temperature viscosity performance of the composition. This gives the combined advantages of cost saving by lower treat rate and improved viscometric performance.

It has further been found that the invention gives better permanent shear stability characteristics as demonstrated in diesel injector testing.

The additive combination of the invention may be used in conjunction with other additives commonly used in lubricating compositions such as metal detergent additives, extreme pressure additives, VI improvers, pour point depressants, anti-foam agents, rust inhibiting agents, anti-oxidants and corrosion inhibiting agents.

Figure 2:
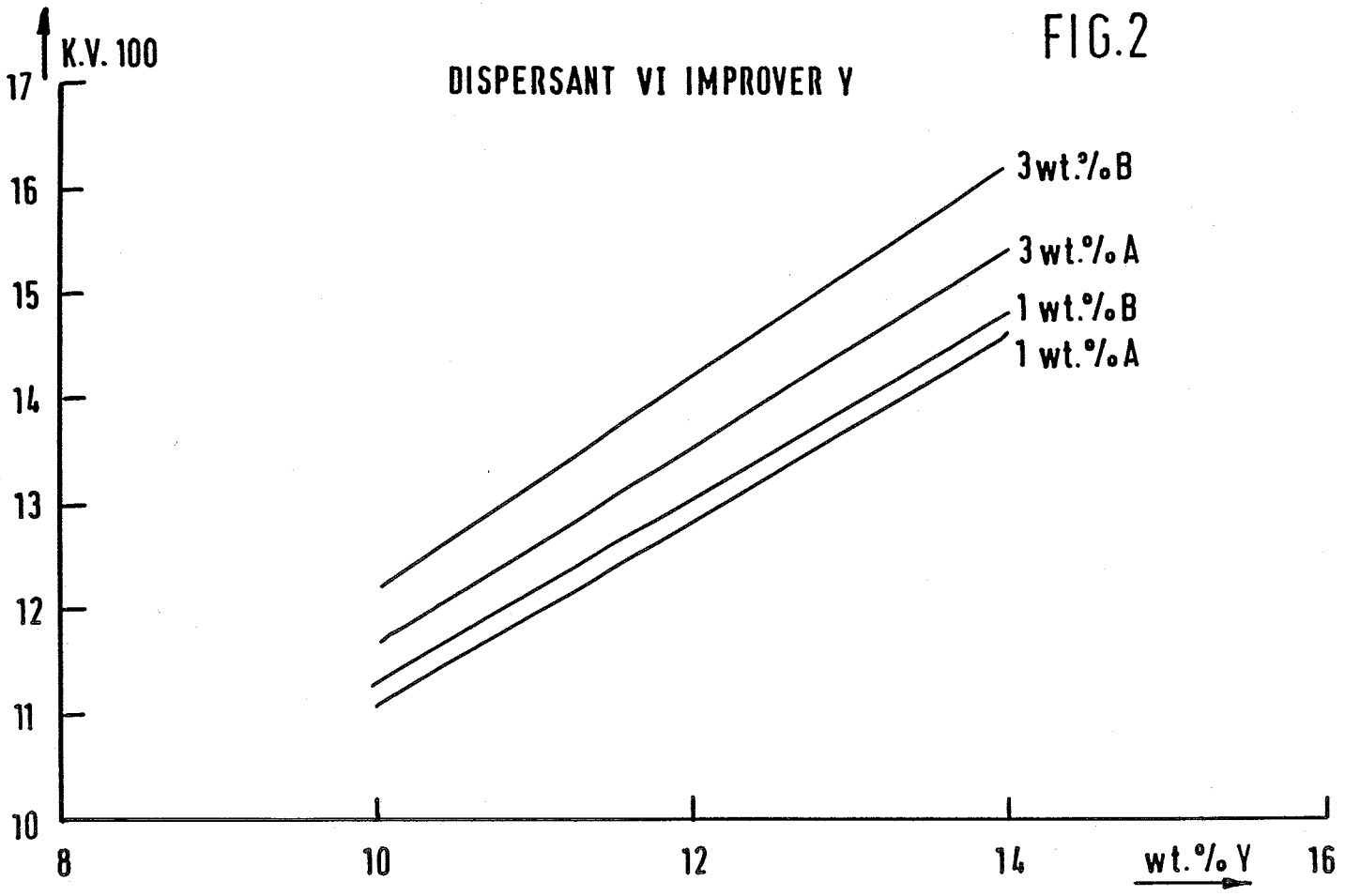
Figure 3:
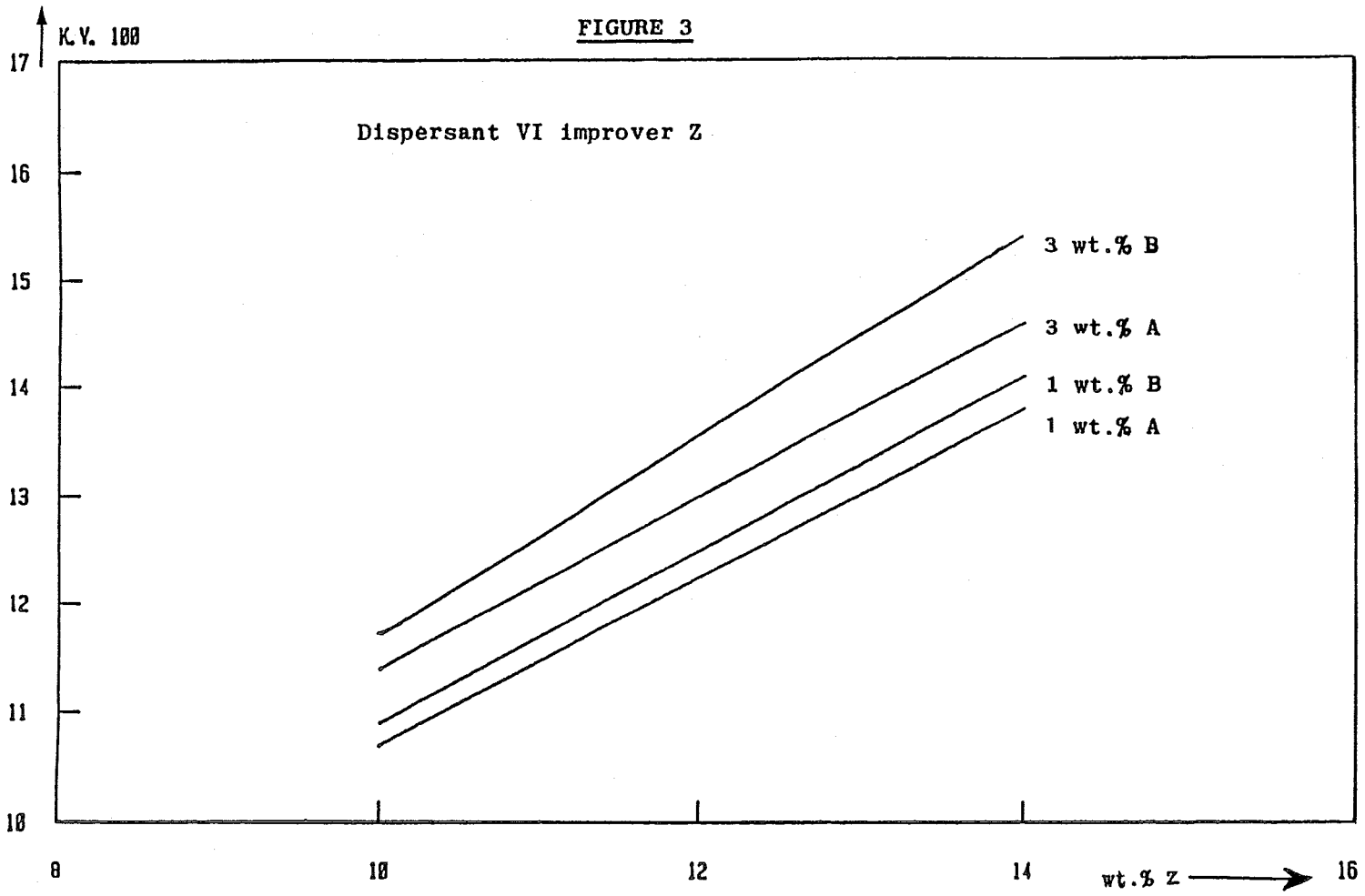
Figure 4:
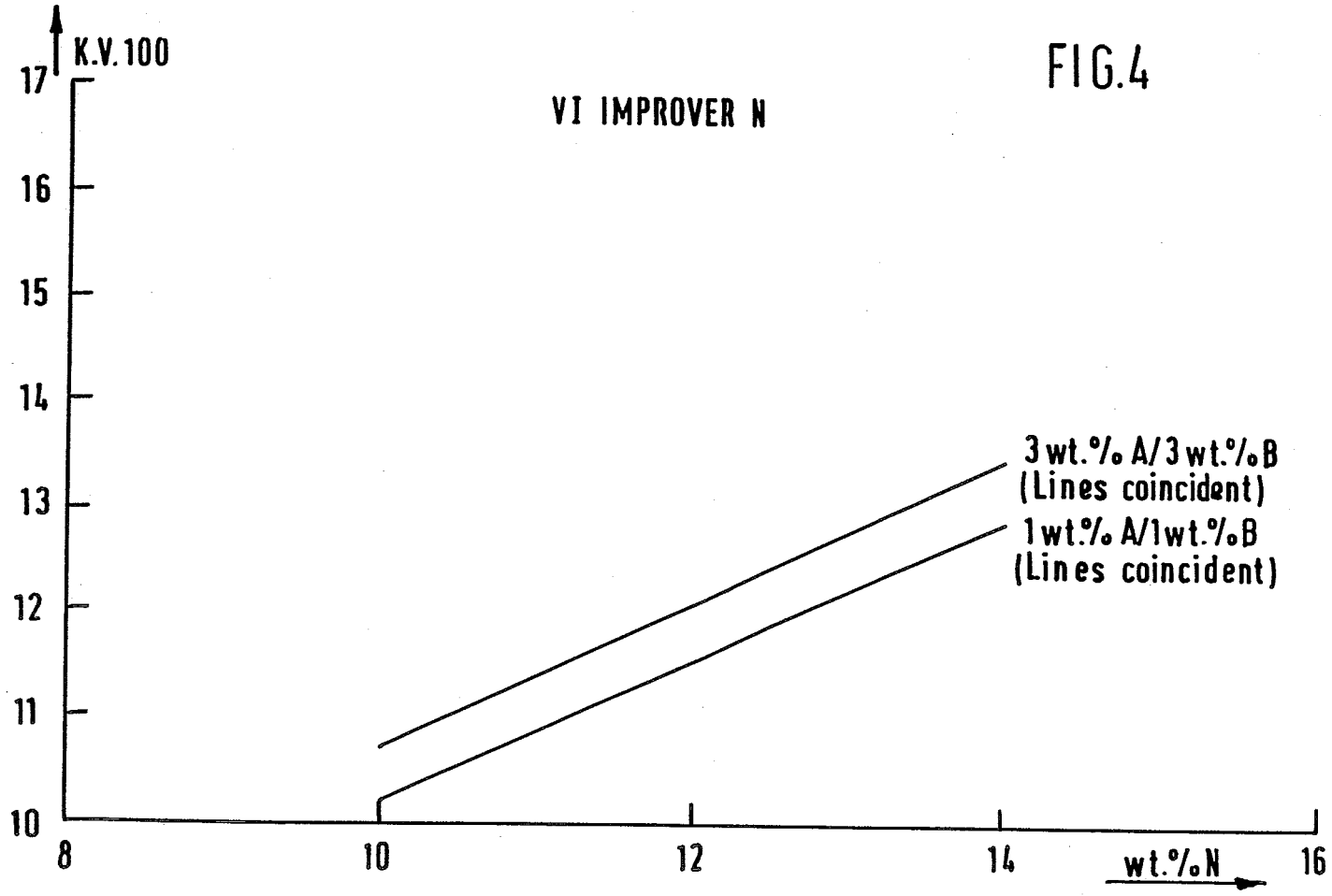
Figure 5:
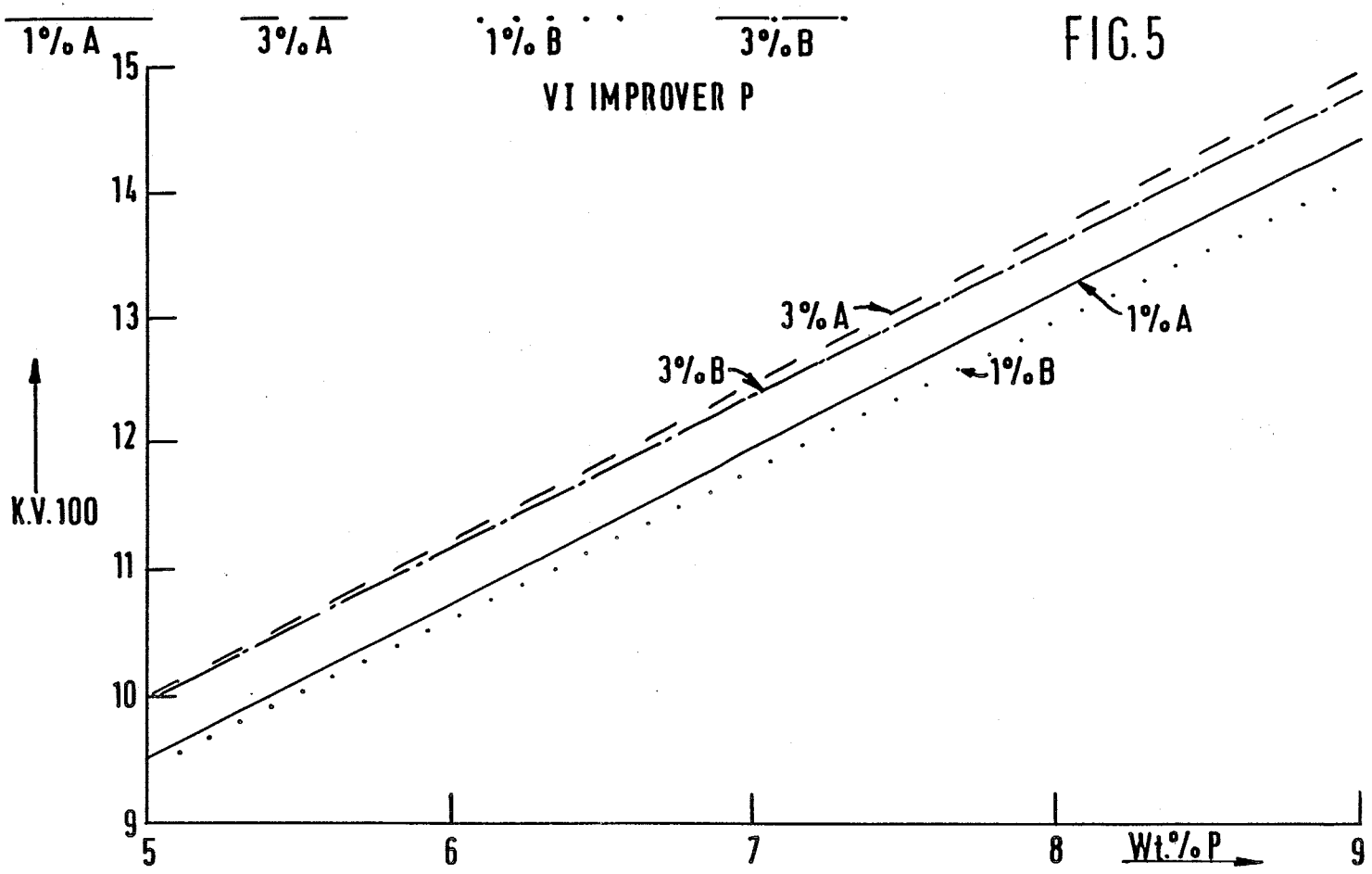

The invention will now be described in more detail though only by way of illustration with reference to the following examples and as illustrated in the accompanying drawings, in which:

FIGS. 1 to 3 are graphs of kinematic viscosity measured at 100° C. (Kv 100 according to the method described in ASTM D445) against the concentration of dispersant VI for various lubricating compositions of the invention with two levels of boron and for comparison lubricating compositions using lower levels of boron; and FIGS. 4 and 5 show similar graphs for comparative lubricating compositions containing no dispersant VI but instead VI improvers with no dispersant activity, illustrating that boron content gives no viscometric benefit.

EXAMPLE 1

A lubricating composition was prepared containing a major amount of a mineral lubricating oil, 3.1 wt.% of a detergent inhibitor additive package comprising an oil solution of overbased magnesium sulphonate, a zinc dialkyl dithiophosphate, a phenolic antioxidant and an additional antioxidant, 0.3 wt.% of an ester based pour point depressant, from 10 to 14 wt.% of various dispersant VI improvers and dispersants with different levels of boron content at treat rates of 1.0 and 3.0 wt.%. The components tested were:

A: a polyisobutenyl succinic anhydride (based on a polyisobutenyl radical or molecular weight 950) reacted with polyethylene amine and borated so that the boron content of the dispersant is 0.35 wt.% and the nitrogen content is 1.58 wt.%.

B: a polyisobutenyl succinic anhydride (based on a polyisobutenyl radical of molecular weight 950) reacted with polyethylene amine and borated so that the boron content of the dispersant is 2.0 wt.% and the nitrogen content is 1.58 wt.%.

The dispersant VI improvers tested were:

X: an oil solution of the product of reacting an ethylene propylene copolymer (M.W. approximately 30,000) with maleic anhydride in the presence of a free radical initiator and polyisobutenyl succinic anhydride subsequently treated with a polyamine and finally a carboxylic acid;

Y: a product similar to X in a lower viscosity diluent oil; and

Z: a product similar to X except that the polyisobutenyl succinic anhydride is omitted and in the final step the carboxylic acid is replaced by an alkaryl sulphonic acid.

By way of comparison similar compositions were prepared replacing the dispersant VI improver by (i) a conventional VI improver comprising an ethylene propylene copolymer without any additional functionality, referred to hereinafter as "N"; and (ii) a commercially available VI improver, being a polymethacrylate "Acryloid 702" (Registered Trademark) available from Rohm and Haas Company hereinafter referred to as "P".

Kv 100 was measured for each formulation and the results are plotted in FIGS. 1–4. FIG. 1 shows the results for lubricating compositions containing dispersant VI improver X and treat rates of 1 and 3 wt.% of each of dispersants A and B. FIG. 2 shows the results for similar compositions using dispersant VI improver Y, FIG. 3 shows the results for similar compositions using dispersant VI improver Z and FIG. 4 shows the results for similar compositions replacing the dispersant VI by the conventional VI improver N.

Therefore, for each dispersant VI improver two different levels of dispersant treatment were tested each with two different levels of boron content, those compositions containing dispersant B in FIGS. 1 to 3 are compositions of the invention and in each case are to be compared with the conventional compositions containing the same treat rate of dispersant A. The higher the Kv 100 measured the better the result. However, FIGS. 1–3 show that a significant improvement is obtained for each dispersant VI improver tested by increasing the boron content according to the invention at each ashless dispersant treat rate tested. Moreover, when using the conventional VI improver N (FIG. 4) or P (FIG. 5) no viscometric improvement is seen by increasing boron level for a given treat rate of dispersant. Indeed in the case of VI improver P (described in EP No. 0042270 in combination with a borated succinimide of unspecified boron content), increasing the boron content of the dispersant gives a slight decrease in viscosity, although this small difference may not be statistically significant.

EXAMPLE 2

Dispersants A and B were tested with dispersant VI improver X in a fully formulated lubricating oil to determine the effect of the additives on low temperature performance as measured in the cold cranking simulator (CCS test as carried out according to ASTM D2602). Each dispersant was tested at levels of 2, 3 and 4 wt.% and in each case they were formulated together with an appropriate amount of dispersant VI improver X to give a target Kv 100 value of 14.5. The results are given in Table 1 and clearly show that to achieve the desired Kv 100 value the formulations of the invention require smaller amounts of dispersant VI improver and the CCS performance is markedly improved.

TABLE 1

| | | | | | | |
|---|---|---|---|---|---|---|
| Dispersant A (wt. %) | 2 | 3 | 4 | — | — | — |
| Dispersant B (wt. %) | — | — | — | 2 | 3 | 4 |
| Boron content (wt. %) | 0.07 | 0.011 | 0.014 | 0.04 | 0.06 | 0.08 |
| VI Improver X (wt. %) | 15.0 | 14.7 | 14.4 | 14.2 | 13.9 | 13.4 |
| Kv 100 (cSt) | 14.30 | 14.45 | 14.57 | 14.11 | 14.39 | 14.52 |
| CCS (poise) at −20° C. | 33.5 | 35.4 | 37.1 | 32.2 | 33.3 | 34.1 |

I claim:

1. A lubricating composition comprising a lubricating oil, from about 1 to about 10%, by weight, based on the composition weight, of at least one nitrogen containing borated ashless dispersant which contains at least 0.5% by weight boron based on the weight of said borated dispersant, from about 5 to about 20%, by weight, based on the composition weight, of at least one dispersant viscosity improver, and boron in an amount of at least 0.02 wt. % of the lubricating composition.

2. A composition as claimed in claim 1, in which the ashless dispersant is a polyisobutenyl succinic anhydride reacted with a polyethylene amine and subsequently treated with a boron compound.

3. A composition as claimed in claim 1, in which the dispersant viscosity improver is a polymer of ethylene with a $C_3$ to $C_{20}$ olefin further reacted either by grafting $C_4$ to $C_{20}$ unsaturated nitrogen-containing monomer thereon or by grafting an unsaturated acid onto the polymer backbone and then reacting said carboxylic acid groups with an amine, hydroxyamine or alcohol.

4. A composition as claimed in claim 1, which contains from 0.05 to 10 wt.% boron.

5. A method for improving the viscometric behavior of a lubricating oil composition containing at least one ashless dispersant and at least one viscosity improver which comprises providing said lubricating oil composition with (a) from about 1 to about 10%, by weight based on the weight of said composition, of a borated ashless dispersant which contains at least 0.5% by weight boron, based on the weight of said borated dispersant, as at least one of said ashless dispersants, (b) from about 5 to about 20%, by weight based on the weight of said composition, of a dispersant viscosity improver as at least one of said viscosity improvers, and (c) boron in an amount of at least 0.02% by weight based on the weight of said composition.

* * * * *

UNITED STATES PATENT AND TRADEMARK OFFICE

CERTIFICATE OF CORRECTION

PATENT NO. : 4,801,390

DATED : January 31, 1989

INVENTOR(S) : Robert Robson

It is certified that error appears in the above-indentified patent and that said Letters Patent is hereby corrected as shown below:

Column 7, line 20, after "composition" insert --exhibiting improved viscometric behavior--.

Column 7, line 26, after "weight, of" insert --an oil solution of--.

Column 8, line 24, after "composition, of" insert --an oil solution of--.

Signed and Sealed this

Nineteenth Day of September, 1995

*Attest:*

Bruce Lehman

BRUCE LEHMAN

*Attesting Officer*

*Commissioner of Patents and Trademarks*